US005931021A

United States Patent [19]

Shnaid et al.

[11] Patent Number: 5,931,021

[45] Date of Patent: Aug. 3, 1999

[54] STRAIGHTFORWARD METHOD AND ONCE-THROUGH APPARATUS FOR GAS LIQUEFACTION

[76] Inventors: Isaac Shnaid, Zalman Shneur St. 36/10, Haifa, Israel, 32545; Dan Weiner, 18A Leah St., Haifa, Israel; Giora Meron, Hashkedeem St. 29, Tivon, Israel, 36000; Shmuel Olek, Kamil Hoismans St. 7, Haifa, Israel, 34987

[21] Appl. No.: 08/880,306

[22] Filed: Jun. 24, 1997

[51] Int. Cl.[6] ..... F25J 1/00

[52] U.S. Cl. ..... 62/613; 62/51.2

[58] Field of Search ..... 62/612, 613, 51.2

[56] References Cited

U.S. PATENT DOCUMENTS 3,362,173 1/1968 Kniel ..... 62/612
4,094,655 6/1978 Krieger ..... 62/612
4,303,427 12/1981 Krieger ..... 62/612
4,671,080 6/1987 Gross ..... 62/51.2

*Primary Examiner*—Ronald Capossela

[57] ABSTRACT

The invention relates to methods and systems for liquefaction of gases whose critical temperature is lower than the ambient temperature, such as, for instance, natural gas, air, nitrogen, oxygen, etc. Compressed to supercritical pressure gas to be liquefied is cooled by external refrigerator means to a predetermined final temperature that is lower than the saturation temperature of the liquefied gas, and then is throttled to a subcritical pressure. As a result, all gas supplied to the apparatus is liquefied without generating any flash gas, and controlled rate of liquefied gas subcooling is achieved. Three modifications of the apparatus for gas liquefaction employing refrigerator means, based on reversed gas cycles, are introduced. Another modification of the apparatus with refrigerator means applying open air cycle and Compressed Air Energy Storage (CAES) is also developed.

11 Claims, 8 Drawing Sheets

STRAIGHTFORWARD METHOD AND ONCE-THROUGH APPARATUS FOR GAS LIQUEFACTION

1 FIELD OF THE INVENTION

This invention relates to cryogenics. More particularly, the invention relates to methods and systems for liquefaction of gases whose critical temperature is lower than the ambient temperature, such as, for instance, natural gas, air, nitrogen, oxygen, etc.

2 BACKGROUND OF THE INVENTION

Liquefaction of gases whose critical temperature is lower than the ambient temperature, is an important field of application of cryogenics. Large gas liquefaction plants are built for LNG production, for space-vehicle launching sites and for other industrial and scientific purposes. Because of this, developing novel methods and devices for gas liquefaction having improved techno-economic characteristics, is a task of great importance. Conventional systems of liquefaction of gases, whose critical temperature is lower than the ambient temperature, produce a mixture of saturated liquid and saturated vapour (see, U.S. Pat. Nos. 4,012,212; 4,147,525; 4,195,979; 4,229,195; 4,456,459; 4,606,744; 4,894,076; 5,473,900, and a book of R. F. Baron, "Cryogenic Systems", Oxford University Press, 1985). This mixture enters a separator where liquid is separated, and vapour—flash gas—returns to a compressor through a heat exchanger utilizing low temperature of vapour for cooling compressed gas to be liquefied. Typically, the mass of the flash gas is 3–10 times more than mass of the liquid. Therefore, reheating and recompressing flash gas requires a large heat transfer surface of the heat exchanger and high supplementary capacity of the compressor. These factors increase capital cost and power consumption of the liquefying systems.

In cases where it is necessary to produce subcooled liquefied gas having a temperature lower than the saturation temperature, conventional liquefying systems include additional elements, for instance additional heat exchanger where boiling at lower pressure liquefied gas extracts heat from the liquefied gas to be subcooled, additional compressor or a vacuum pump, etc. (see, U.S. Pat. No. 4,575,386).

It is an object of this invention to provide a new Straightforward Method and Once-Through-Apparatus for Gas Liquefaction producing subcooled liquefied gas with an easily controlled temperature and without generating any flash gas.

3 SUMMARY OF THE INVENTION

In accordance with the invention, compressed to supercritical pressure gas is cooled by external refrigerator means to a predetermined final temperature that is lower than the saturation temperature of the liquefied gas, and then the cooled supercritical pressure gas is throttled to a prescribed subcritical pressure of the liquid. As a result, all gas supplied to the apparatus is liquefied without generating any flash gas. Controlling the final temperature of the cooled supercritical pressure gas ensures obtaining after throttling subcooled liquefied gas, having a prescribed temperature. External refrigerator means generating distributed variable temperature heat sinks are applied. Two main options are technically available. The first is refrigerator means producing variable temperature flows of a cold gas. Another option is refrigerator means employing multicomponent refrigerants boiling at variable temperature. In the first case, the refrigerator means is based on various modifications of reversed gas cycles. Because of this, the refrigerator means have simple schemes and ensure high thermodynamic efficiency of cooling at variable temperature. Three modifications of the Once-Through-Apparatus for Gas Liquefaction employing refrigerator means of this type are introduced. Another modification of the apparatus employing variable temperature cold air flow and refrigerator means with Compressed Air Energy Storage (CAES) is also developed.

A special startup mode of operation of the Once-Through-Apparatus for Gas Liquefaction ensures fast initial cooling of the apparatus.

Accordingly, several other objects and advantages of the Once-Through-Apparatus for Gas Liquefaction are as follows:

1. It is supposed to be the simplest device for producing liquefied gas having any prescribed thermodynamic parameters—pressure and temperature.
2. In this apparatus, exergetic losses during throttling supercritical pressure cooled gas are negligibly small, exergetic losses of cooling the gas by refrigerator means can be minimized, and flash gas at normal working conditions does not appear. It means that low capital cost and high thermodynamic efficiency of the liquefaction can be achieved.
3. The apparatus can be applied for liquefying any gas.

The invention will now be illustrated in the following description with occasional reference to the annexed drawings.

4 BRIEF DESCRIPTION OF THE DRAWINGS

5 DETAILED DESCRIPTION OF THE INVENTION

Figure 1:
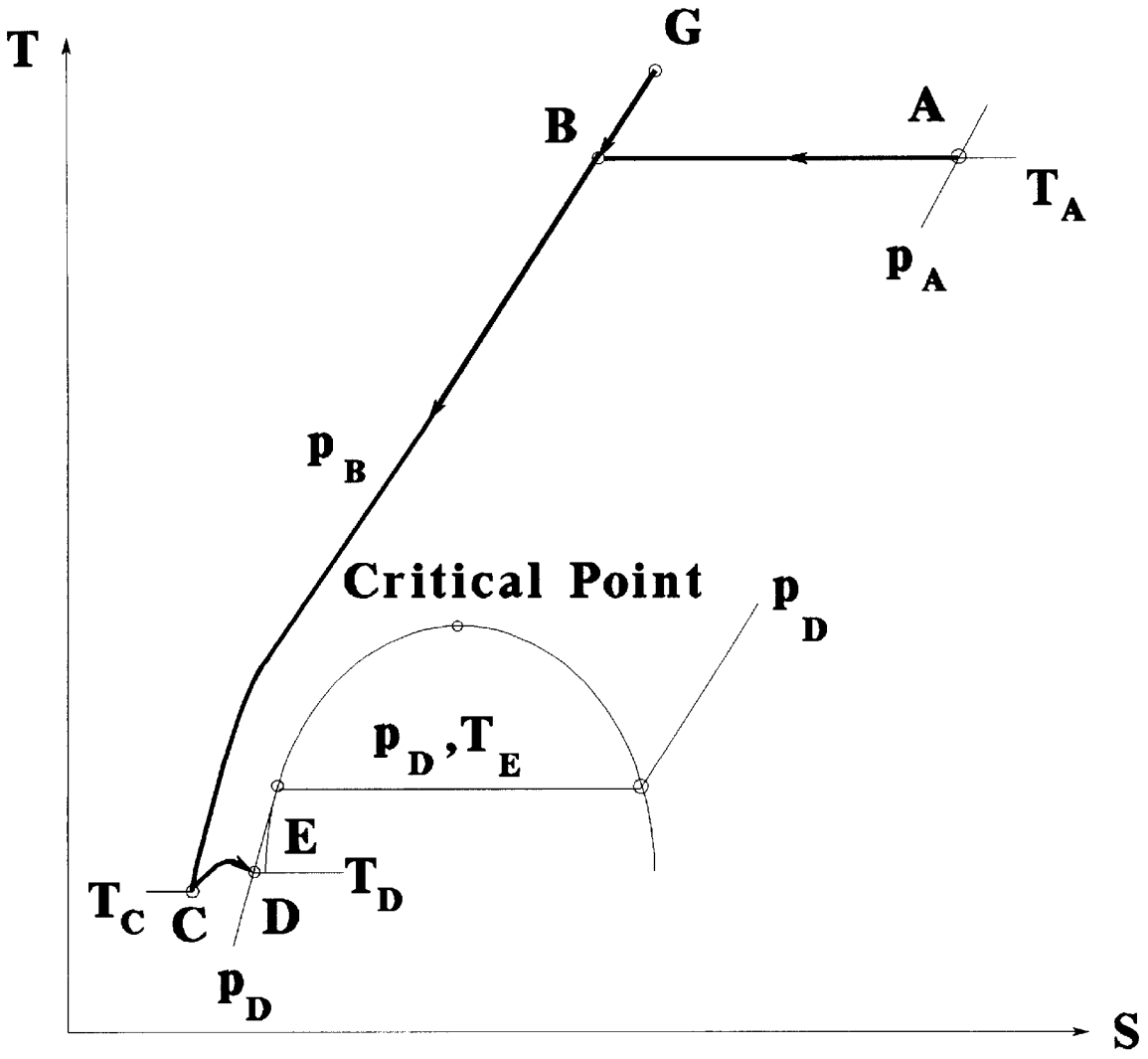
FIG. 1 is a thermodynamic diagram illustrating Straightforward Method of Gas Liquefaction.

For a full understanding of the principles and features of this invention, reference will now be made to the embodiments illustrated by drawings. Nevertheless, it should be understood that no excess limitations are thereby introduced.

In all drawings, the same reference numerals denote the same components, and the same capital letters denote the same thermodynamic state of the gas or liquid.

Referring to FIG. 1, thermodynamic processes forming a Straightforward Method of Liquefying Gases, on which is based a Once-Through-Apparatus for Liquefying Gases, are shown using a thermodynamic temperature-entropy diagram. In this diagram, points A, B and G characterize various cases of initial thermodynamic conditions of the gas to be liquefied. Point D characterizes final stage of the liquefying process—thermodynamic state of liquefied gas having prescribed pressure $p_D$ and temperature $T_D$. It is suggested that the liquefied gas temperature can be lower than the liquefied gas saturation temperature $T_E$ corresponding to pressure $p_D$. The latter condition means that the liquefied gas is subcooled.

The Straightforward Method of Gas Liquefaction comprises the following sequential steps:

Step No.1. Thermodynamic conditioning of the gas to be liquefied (thermodynamic process A-B or G-B).

Step No.2. Cooling the supercritical pressure $p_B$ gas by external refrigerator means to the predetermined final temperature that is lower than the saturation temperature of the liquefied gas (thermodynamic process B-C).

Step No.3. Throttling the cooled supercritical pressure gas to prescribed subcritical pressure of the liquefied gas (thermodynamic process C-D). As a result, the liquefied gas having prescribed pressure and temperature is obtained.

In the Step No.1 thermodynamic conditioning of the gas to be liquefied is provided. During it, the gas supercritical pressure and minimal temperature consistent with ambient conditions are achieved. Several cases corresponding to various initial thermodynamic conditions of the gas must be taken into account:

Case No.1. Gas initial pressure is subcritical. During thermodynamic conditioning, gas is compressed and cooled by ambient heat sinks (water, air etc.). Isothermal process A-B is a simplified and an idealized representation of the gas multistage compression and cooling.

Case No.2. Gas initial pressure is supercritical, and gas initial temperature is higher than the ambient temperature. During thermodynamic conditioning gas is cooled by ambient heat sinks (water, air etc.). Thermodynamic process G-B represents this case.

Case No.3. Gas initial pressure is supercritical, and its initial temperature is equal or lower than the ambient temperature. For this case described by point B, no thermodynamic conditioning is needed.

Case No.1 is the most typical, while cases No.2 and No.3 can be met rarely, for instance, when liquefying of natural gas occurs and gas is taken from a high pressure pipeline or from a high pressure production well.

In Step No.2 the supercritical pressure gas is cooled to the predetermined final temperature $T_c$ that is lower than the saturation temperature of the liquefied gas $T_E$. The thermodynamic process B-C describing this step occurs at variable temperature. Any refrigerator means generating distributed variable temperature heat sinks, may be applied for cooling the supercritical pressure gas.

Throttling of the cooled supercritical pressure gas C-D is the last step of the Straight-forward Method of Gas Liquefaction. The throttling is provided from supercritical pressure to prescribed subcritical pressure of the liquefied gas $p_D$. As a result, the thermodynamic state of liquefied gas, characterized by point D in the temperature-entropy diagram, is straightforwardly achieved, and no flash gas appears. For the throttling process C-D, a functional relation between thermodynamic parameters of the initial and final states exists $$F(T_c, P_c, T_D, p_D)=0$$

It means that for prescribed temperature and pressure of the liquefied gas TD and PD and known initial pressure of the throttling $p_c$, the temperature of the cooled supercritical pressure gas $T_c$ is predetermined.

The above described considerations lead to a conclusion that by changing the temperature $T_c$ of the cooled supercritical pressure gas, the temperature of the liquefied gas TD may be controlled in such a way that subcooled liquefied gas with a predetermined rate of subcooling $T_E$-$T_D$ is obtained.

In most of cases, the liquefied gas can be considered as practically incompressible liquid whose density $\rho_l$ and isobaric heat capacity $c_{pl}$ do not depend on pressure, and the function F may be presented as $$T_D - T_C + \frac{p_D - p_C}{\rho_l c_{pl}} = 0$$

This formula can be used for engineering estimation of the predetermined temperature of the cooled supercritical pressure gas $T_c$. It shows that $T_c<T_D$, i.e. during throttling C-D temperature increases.

The Straightforward Method of Gas Liquefaction may be applied to any gas. Thermodynamic efficiency of the method depends on efficiency of processes forming all its steps. Thermodynamic conditioning of the gas in Step No.1 and cooling supercritical pressure gas in Step No.2 are processes which in an ideal case are reversible. It means that in a real case, these processes can be provided with minimal exergy losses and therefore with high efficiency. For Step No.3, due to throttling of the gas, irreversibility always occurs and exergy losses are determined by the following expression $$\Pi_t = -T_{amb}\int_C^D \frac{dp}{\rho T}$$

where $T_{amb}$ denotes the ambient temperature, p, T and ρ denote the gas pressure, temperature and density, respectively. This formula shows that for the throttling process C-D, exergy losses are expected to be small because the throttling occurs in a region where the density of the gas is very high.

Table 1 presents thermodynamic characteristics of the Straightforward Method of Gas Liquefaction. The data are introduced for gases having normal temperature of saturation varying in a wide range from 4.2 K to 111.7 K. For various gases, the table gives values of temperature and pressure in characteristic points shown in FIG. 1, exergy losses $\Pi_t$ for throttling C-D, exergy of the liquefied gas El which is equal to the minimal work of the gas liquefaction, and ratio $\Pi_t/E_l$. For calculations, it is assumed that $T_A$=300 K, and $p_A$=1.01 bar; the liquefied gas is under atmospheric pressure $p_D$=1.01 bar and is not subcooled $T_D$=$T_E$; $p_B$=1.5$p_{cr}$, where $p_{cr}$ is the gas critical pressure. The table shows that exergy losses for throttling C-D are very small: only for He-4 they are close to 5% of $E_l$, in all other cases their values are close to 1% of $E_l$, i.e. are negligibly small. Therefore, a high thermodynamic efficiency of the Straightforward Method of Gas Liquefaction, and based on it, a Once-Through-Apparatus for Gas Liquefaction is predicted.

TABLE 1

Thermodynamic Characteristics of the Straightforward Method of Gas Liquefaction

| Gas | $T_D = T_E$, K | $p_B$, bar | $T_C$, K | $E_l$, $\frac{kJ}{kg}$ | $II_t$, $\frac{kJ}{kg}$ | $\frac{II_t}{E_l}$ |
|---|---|---|---|---|---|---|
| He-4 | 4.2 | 3.3 | 3.8 | 6819. | 335.7 | 0.049 |
| $H_2$ | 20.3 | 18.8 | 16.9 | 12019. | 119.8 | 0.010 |
| Ne | 27.1 | 38.1 | 25.3 | 1335. | 19.3 | 0.014 |
| $N_2$ | 77.4 | 49.3 | 74.3 | 768. | 7.8 | 0.010 |
| Air | 78.8 | 56.5 | 75.6 | 739. | 7.7 | 0.010 |
| CO | 81.6 | 51.5 | 78.9 | 769. | 8.6 | 0.011 |
| Ar | 87.3 | 70.7 | 82.3 | 479. | 4.1 | 0.009 |
| $O_2$ | 90.2 | 75.6 | 86.2 | 636. | 5.6 | 0.009 |
| $CH_4$ | 111.7 | 69.5 | 106.8 | 1039. | 9.2 | 0.009 |

Figure 2:
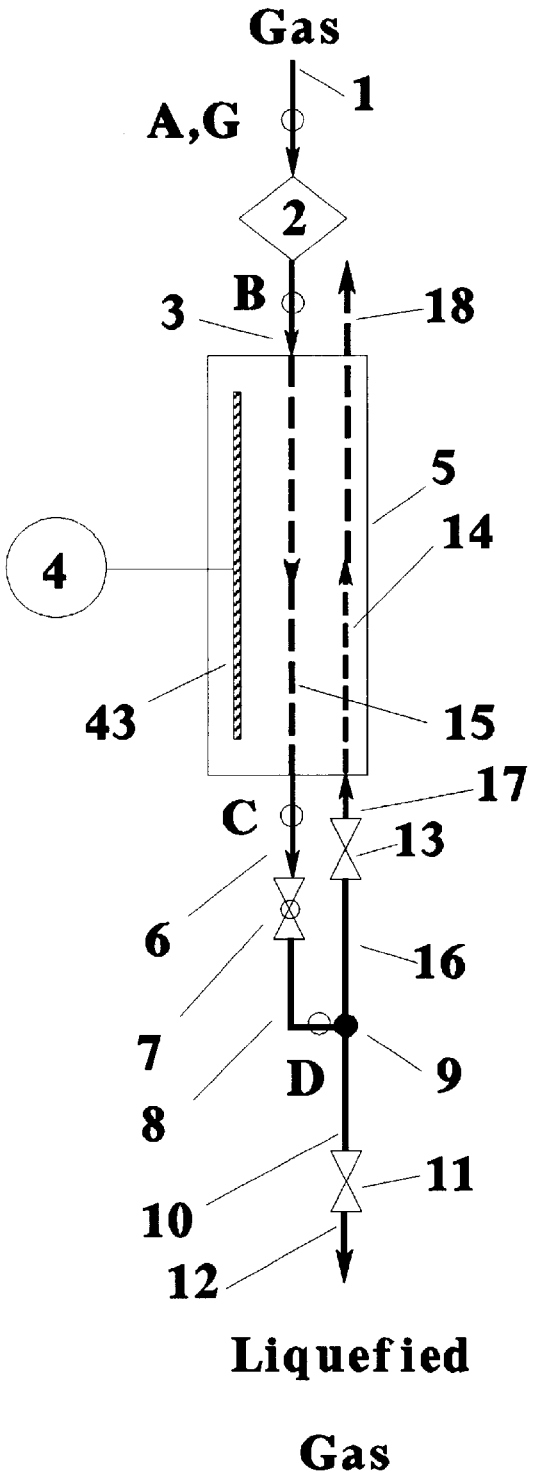
FIG. 2 is a schematic diagram of a Once-Through-Apparatus for Gas Liquefaction.

Referring to FIG. 2, a preferred embodiment of the Once-Through-Apparatus for Gas Liquefaction is schematically shown. It comprises connected in series an inlet line 1, a device 2 for thermodynamic conditioning of the gas to be liquefied, a line 3, main heat transfer means 15, a line 6, a throttling device 7, a line 8, an interconnection element 9, a line 10, a valve 11, and an outlet line 12. Apparatus includes also connected in series a line 16, a valve 13, a line 17, auxiliary heat transfer means 14, a line 18, while the line 16 is connected to the element 9. Heat transfer means 14 and 15 are located in a low temperature heat transfer unit 5, which comprises also heat absorbing means 43 of the external refrigerator means 4. The means 14, 15 and 43 are in thermal contact ensuring heat exchange between them. In the FIGS. 2, 3, 6 and 7, letters A, G, B, C and D describe the thermodynamic state of the gas or the liquid in appropriate points of the apparatus according to notations given in FIG. 1.

In the above described Case No.1, device 2 for thermodynamic conditioning of the gas to be liquefied comprises compressor means, where the gas is compressed to supercritical pressure, and heat exchangers serving for cooling the compressed gas by the ambient heat sinks (water, air etc.). In Case No.2, device 2 comprises heat exchanger where supercritical pressure gas is cooled by the ambient heat sinks (water, air etc.). In Case No.3, no thermodynamic conditioning of the gas is needed.

The heat transfer means 14 and 15, the throttling device 7, and the valves 11 and 13 are of any type known in the art. The device 2 for thermodynamic conditioning of the gas comprises compressors and heat exchangers of any type known in the art.

During startup of the Once-Through-Apparatus for Gas Liquefaction, the valve 11 is closed, the valve 13 is opened, and the refrigerator means 4 are activated. Through the inlet line 1 the gas is supplied to the device for thermodynamic conditioning 2. After it the gas has supercritical pressure and a minimal temperature consistent with the ambient conditions. From the element 2 the gas is supplied through the line 3 to the main heat transfer means 15 where it is cooled by the heat absorbing means 43. Cooled gas passes through the line 6 and the throttling device 7 where it expands without work performance, and its pressure becomes subcritical, and through the line 16 enters the auxiliary heat transfer means 14. There, the gas extracts additional heat from the main heat transfer means 15, accelerating cool-down of the system. From the element 14 reheated gas is evacuated through the line 18.

At the end of the startup period, when the predetermined low gas temperature in the point D is achieved, the gas liquefaction mode of operation of the apparatus is available. In this mode of operation, the valve 11 is opened and the valve 13 is closed. Gas to be liquefied is supplied through the inlet line 1 to the device for thermodynamic conditioning 2. After it, the gas has supercritical pressure and minimal temperature consistent with the ambient conditions. Then, the gas through the line 3 enters the heat transfer means 15, where supercritical pressure gas is cooled by the heat absorbing means 43 to the predetermined final temperature, which is lower then the saturation temperature of the liquefied gas. From the heat transfer means 15, the supercritical pressure gas through the line 6 is delivered to the throttling device 7 and, after it, liquefied gas of prescribed pressure and temperature is received, and this liquid through the lines 8, 10 and 12 is supplied to the consumer.

The minimal losses of exergy during cooling of the supercritical pressure gas in the heat transfer unit 5 are achieved when the temperature difference between substances in the heat transfer means 15 and the heat absorbing means 43 is minimal. Therefore, for high thermodynamic efficiency of the apparatus, refrigerator means generating in the heat absorbing means 43 distributed variable temperature heat sinks is to be applied. Technically, this condition may be easily satisfied if the refrigerator means 4 produces variable temperature flows of cold gas. Another option is application of multicomponent refrigerants boiling at variable temperature. In the first case, the refrigerator means is based on various modifications of reversed gas cycles. Because of this, the refrigerator means are simple and ensure high thermodynamic efficiency of cooling at variable temperature.

Figure 3:
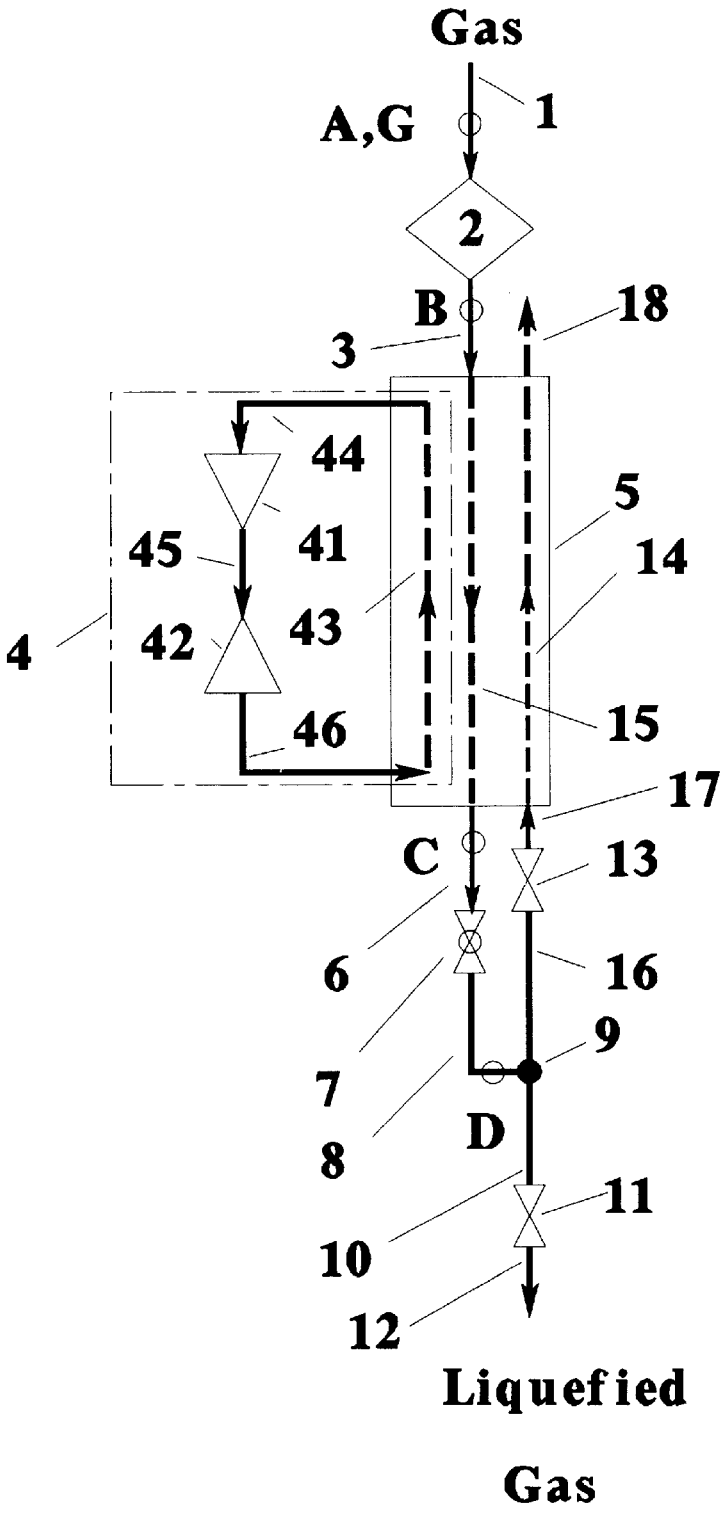
FIG. 3 is a schematic diagram illustrating an useful modification of the apparatus of FIG. 2 where the refrigerator means generates variable temperature gas flow using a simple reversed gas cycle.

Referring to FIG. 3, a preferred embodiment of the Once-Through-Apparatus for Gas Liquefaction, where the refrigerator means generates variable temperature gas flow applying simple reversed gas cycle, is shown. In this case, the refrigerator means 4 comprises compressing and cooling device 41 combining compressor means for compressing gaseous refrigerant with appropriate heat exchanger means for cooling compressed refrigerant by the ambient heat sinks (water, air etc.), expander means 42 for expanding the compressed refrigerant with performance of work, heat absorbing means 43 for extracting heat from supercritical pressure gas by a flow of expanded gaseous refrigerant, and lines 44, 45 and 46 connecting all these elements in series.

The compressing and cooling device 41, the expander means 42 and the heat absorbing means 43 may be of any type known in the art. In the heat transfer unit 5, the refrigerant and the supercritical pressure gas are in counterflow.

Any gas, which is not liquefied under thermodynamic conditions of the refrigerator means cycle, may be chosen as a refrigerant.

In the operational mode of the apparatus shown on FIG. 3, the refrigerant is compressed and cooled in device 41, then it is expanded with performance of work in the element 42. During expansion, its temperature becomes lower than the ambient temperature. Cold refrigerant passes through the heat absorbing means 43 and in counterflow cools the supercritical pressure gas flowing in the main heat transfer means 15.

Application of the simple reversed gas cycle is limited by maximal allowable value of the cycle pressure ratio. The lower the temperature is in the point C, the higher is the simple cycle pressure ratio. Because of this, the simple reversed gas cycle may be successfully used for natural gas liquefaction, but it becomes impractical for liquefaction of gases whose critical temperature is lower, such as, for instance, air, oxygen, nitrogen, hydrogen etc. The problem can be solved by plurality of reversed gas cycles producing refrigeration at successively lower temperatures. For this purpose, the total temperature interval $T_B$-$T_c$ is divided into several subintervals. In every subinterval the cooling is provided by a separate flow of gas generated by its cycle. To adjust the cycles to optimal thermodynamic conditions, they may have different pressure ratios. From an engineering point of view, it is convenient to have the same minimal pressure of the refrigerant in all cycles and different maximal pressures, respectively. One of the cycles is a simple cycle, and the rest of them are regenerative cycles.

Figure 4:
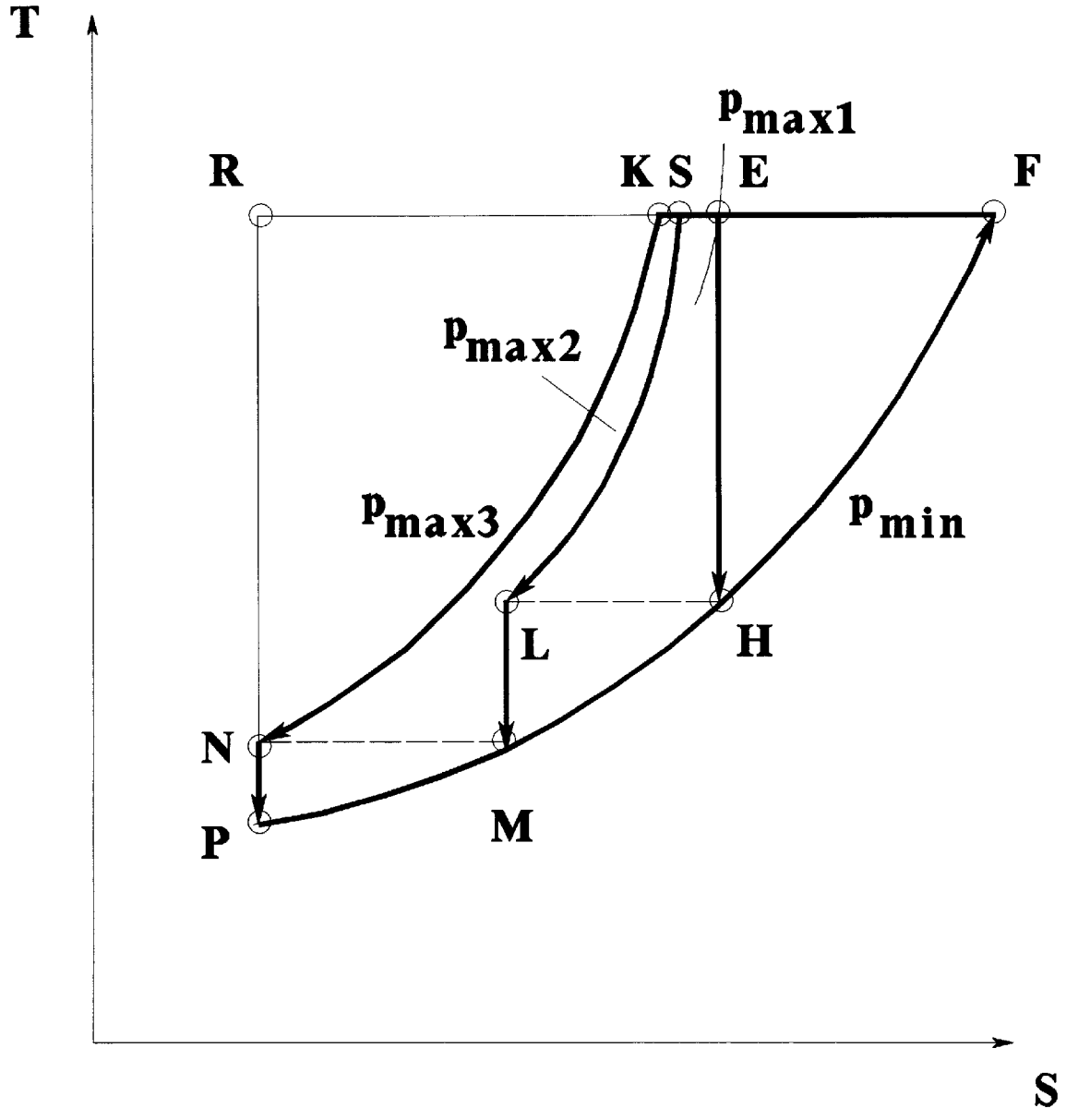
FIG. 4 is a thermodynamic diagram illustrating application of plurality of reversed gas cycles, having the same minimal and different maximal pressure, for generating plurality of variable temperature cold gas flows.

FIG. 4 illustrates using a temperature-entropy diagram, how plurality of reversed gas cycles provides cooling at variable temperature. Three cycles producing refrigeration at successively lower temperatures are shown. All cycles have the same minimal pressure $p_{min}$ and different maximal pressures $p_{max1}$, $p_{max2}$, $p_{max3}$. The first F-E-H-F is a simple cycle, while the second cycle F-S-L-M-H-F and the third cycle F-K-N-P-M-F are regenerative. In the first cycle, process F-E is compression and cooling by ambient heat sinks, E-H is expansion with work performance, and H-F is heat absorption from the supercritical pressure gas to be cooled. In the second cycle, process F-S is compression and cooling by ambient heat sinks, L-M is expansion with work performance, M-H is heat absorption from the supercritical pressure gas to be cooled, and processes S-L and H-F take place in a regenerative heat exchanger. In the third cycle, process F-K is compression and cooling by ambient heat sinks, N-P is expansion with work performance, P-M is heat absorption from the supercritical pressure gas to be cooled, and processes K-N and M-F take place in regenerative heat exchanger. The simple cycle F-R-P-F ensures refrigeration in the same temperature range as all three introduced cycles but it needs much greater pressure ratio.

Figure 5:
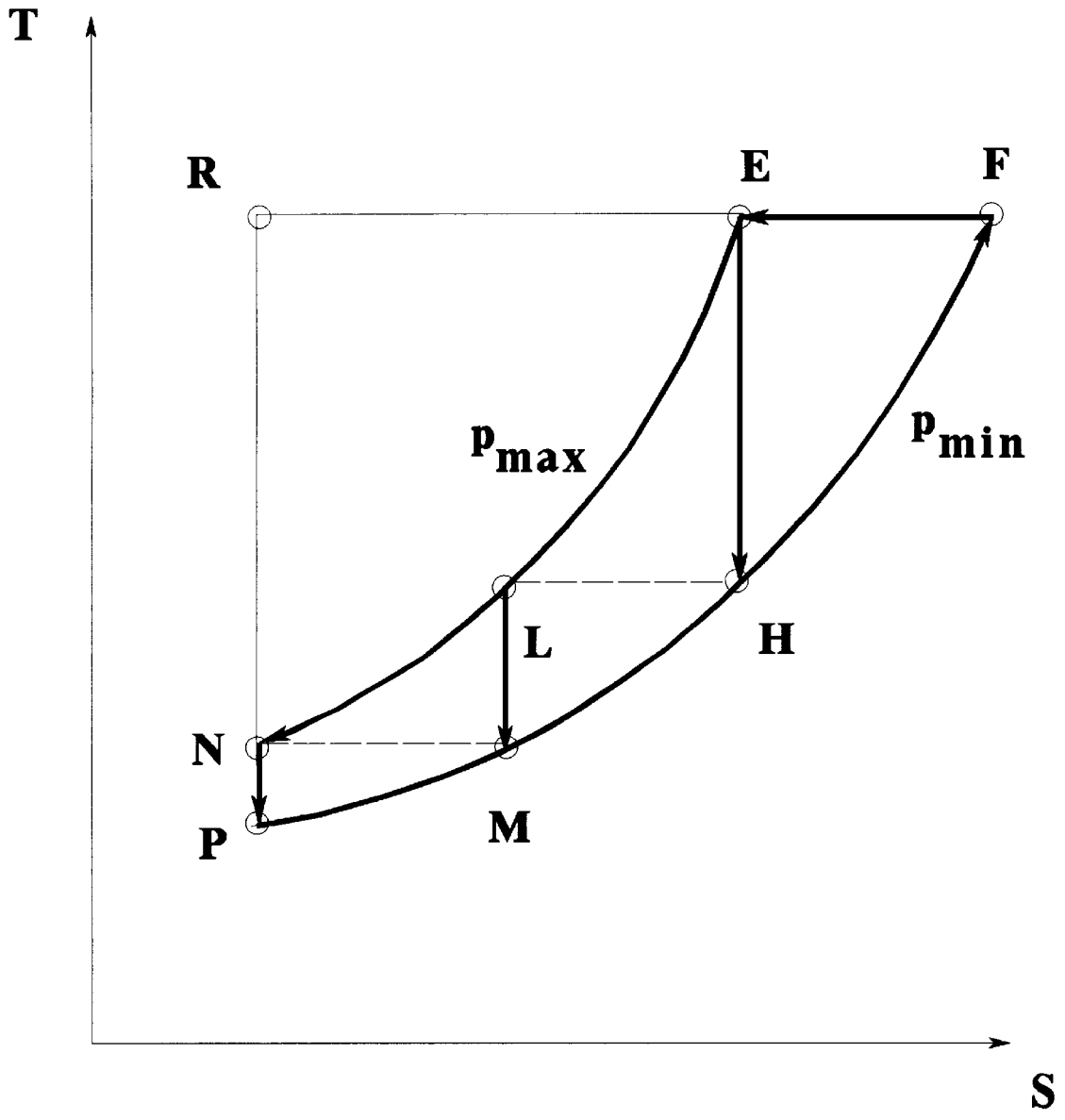
FIG. 5 is a thermodynamic diagram illustrating application of plurality of reversed gas cycles, having the same minimal and the same maximal pressure, for generating plurality of variable temperature cold gas flows.

FIG. 5 shows a case of cooling in the same three subintervals, but all cycles—one simple F-E-H-F and two regenerative F-E-L-M-H-F and F-E-N-P-M-F—have the same maximal $p_{max}$ and minimal $p_{min}$ pressure. The simple cycle is the same as in FIG. 5. The first regenerative cycle includes the following processes: compression and cooling F-E, regenerative heat exchange E-L and H-F, expansion with work performance L-M, and heat absorption M-H. In the second regenerative cycle, E-F is compression, E-N and M-F—regenerative heat exchange, N-P—expansion with work performance, P-M—heat absorption. In the case of equal maximal cycle pressure, heat exchanger devices of refrigerator means may have simpler design.

Figure 6:
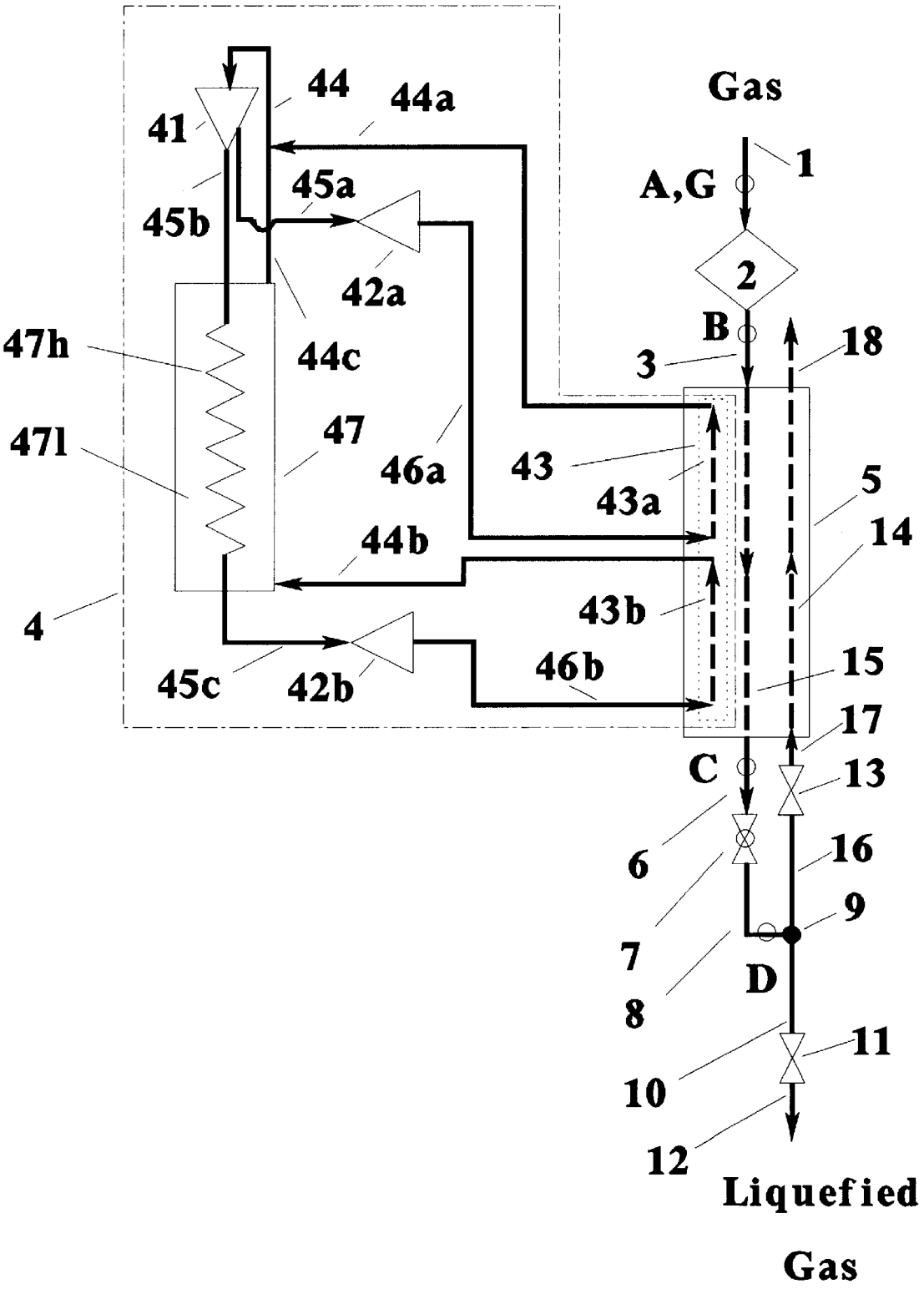
FIG. 6 is a schematic diagram illustrating another useful modification of the apparatus of FIG. 2 where the refrigerator means applies plurality of reversed gas cycles with the same minimal pressure, and a separate regenerative heat exchanger.

Referring to FIG. 6, a preferred embodiment of the Once-Through-Apparatus for Gas Liquefaction, where the refrigerator means apply plurality of reversed gas cycles, at least two, is schematically shown. The case of the same minimal pressure in cycles is considered. The compressing and cooling device 45 has two exhaust lines 45*a* and 45*b* and one suction line 44. The refrigerator means comprise also the first and the second expander means 42*a* and 42*b*, the first 43*a* and the second 43*b* sections of heat absorbing means 43, lines 44*a*, 44*b*, 44*c*, 45*c*, 46*a*, 46*b* and also a regenerative heat exchanger 47 having a high pressure side 47*h* and a low pressure side 47*l*. In the refrigerator means, two circuits are created. The first includes connected in series elements 45*a*, 42*a*, 46*a*, 43*a* and 44*a*. The second circuit contains elements 45*b*, 47*h*, 45*c*, 42*b*, 46*b*, 43*b*, 44*b*, 47*l* and 44*c* connected in series. The lines 44*a*, 44*c* and 44 are connected together. All elements of the refrigerator means 4 are of any type known in the art.

During operation of the apparatus, the compressing and cooling device 41 produces two flows of compressed and cooled refrigerant having, in a general case, different pressures and mass flow rates. In a particular case, the flows may have equal pressures or equal mass flow rates, or simultaneously equal pressures and equal mass flow rates. The first flow is delivered by the line 45*a* to the first expander means 42*a*, expands there with work performance and then is delivered by the line 46*a* to the first section 43*a* of the heat absorbing means 43 where it cools the supercritical pressure gas. Then the first flow of the refrigerant enters the line 44*a*. The second flow of the compressed and cooled refrigerant through the line 45*b* is delivered to the high pressure side 47*h* of the heat exchanger 47, then this flow passes the line 45*c* and enters the second expander means 42*b* where it expands with work performance. After expansion, the second flow of the refrigerant is delivered by the line 46*b* to the second section 43*b* of the heat absorbing means 43, where it additionally cools the supercritical pressure gas. Then this flow is delivered by the line 44*b* to the low pressure side 471 of the heat exchanger 47 where it cools the refrigerant flowing through the high pressure side 47*h*. From the low pressure side 47*l* of the heat exchanger 47, the refrigerant is evacuated through the line 44*c*. As the lines 44*a* and 44*c* are connected, both expander means 42*a* and 42*b* have practically the same exhaust pressure, and the suction line 44 supplies all refrigerant to the element 41.

In this embodiment, the total temperature interval $T_B$-$T_c$ of cooling supercritical pressure gas is divided into two parts, and because of this, every expander means works at a smaller pressure ratio than the expander means in the embodiment of FIG. 3. Varying pressure ratio and mass flow rate of the refrigerant in every expander means 42*a* and 42*b* makes possible to optimize techno-economic characteristics of the apparatus.

Figure 7:
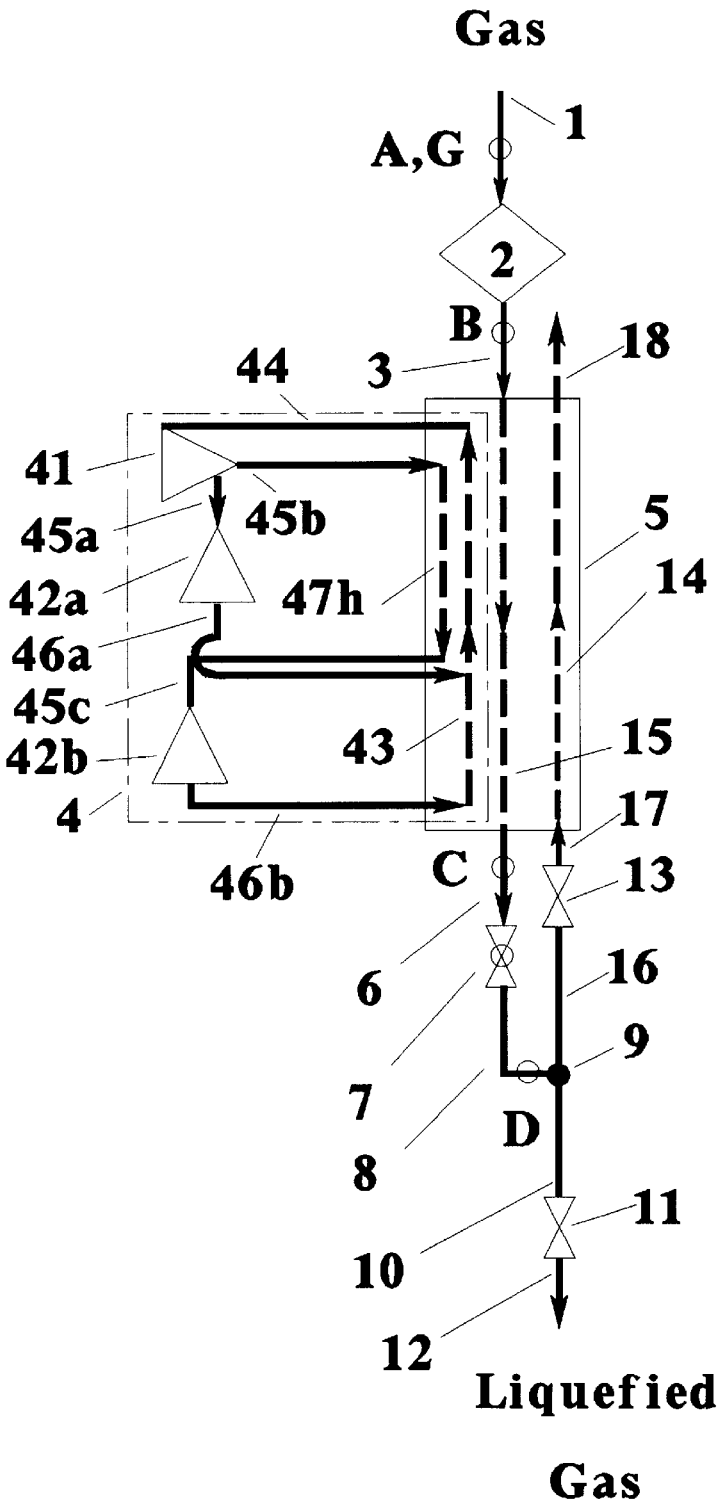
FIG. 7 is a schematic diagram illustrating another useful modification of the apparatus of FIG. 2 where the refrigerator means applies plurality of reversed gas cycles with the same minimal pressure, and a regenerative heat exchanger combined with the refrigerator heat absorbing means.

Referring to FIG. 7, a preferred embodiment of the apparatus is schematically shown for a case where the refrigerator means applies plurality of reversed gas cycles with the same minimal pressure, and a regenerative heat exchanger is combined with the refrigerator heat absorbing means. The scheme is similar to one of the FIG. 2 and uses the same notations. Here the high pressure side 47*h* of the regenerative heat exchanger is in heat contact with the heat absorbing means 43, and the expander exhaust line 46*a* introduces refrigerant in an intermediate point of the heat absorbing means 43.

During operation of the apparatus, the compressing and cooling device 41 produces two flows of compressed and cooled refrigerant having, in a general case, different pressures and mass flow rates. The first flow is delivered by the line 45*a* to the first expander means 42*a*, expands there with work performance and then is delivered by the line 46*a* to the intermediate point of the heat absorbing means 43. The second flow of the compressed and cooled refrigerant through the line 45*b* is delivered to the high pressure side 47*h* of the heat exchanger, then this flow passes through the line 45*c* and enters the second expander means 42*b* where it expands with work performance. After expansion, the second flow of the refrigerant is delivered by the line 46*b* to low temperature part of the heat absorbing means 43, where it cools supercritical pressure gas in the element 15. Then this flow is combined with flow from the expander means 42*a*, and the combined flow refrigerates simultaneously supercritical pressure gas in the element 15 and refrigerant in the element 47*h*. From the element 15 the refrigerant is evacuated through an outlet line 44 to the inlet of the device 41.

Figure 8:
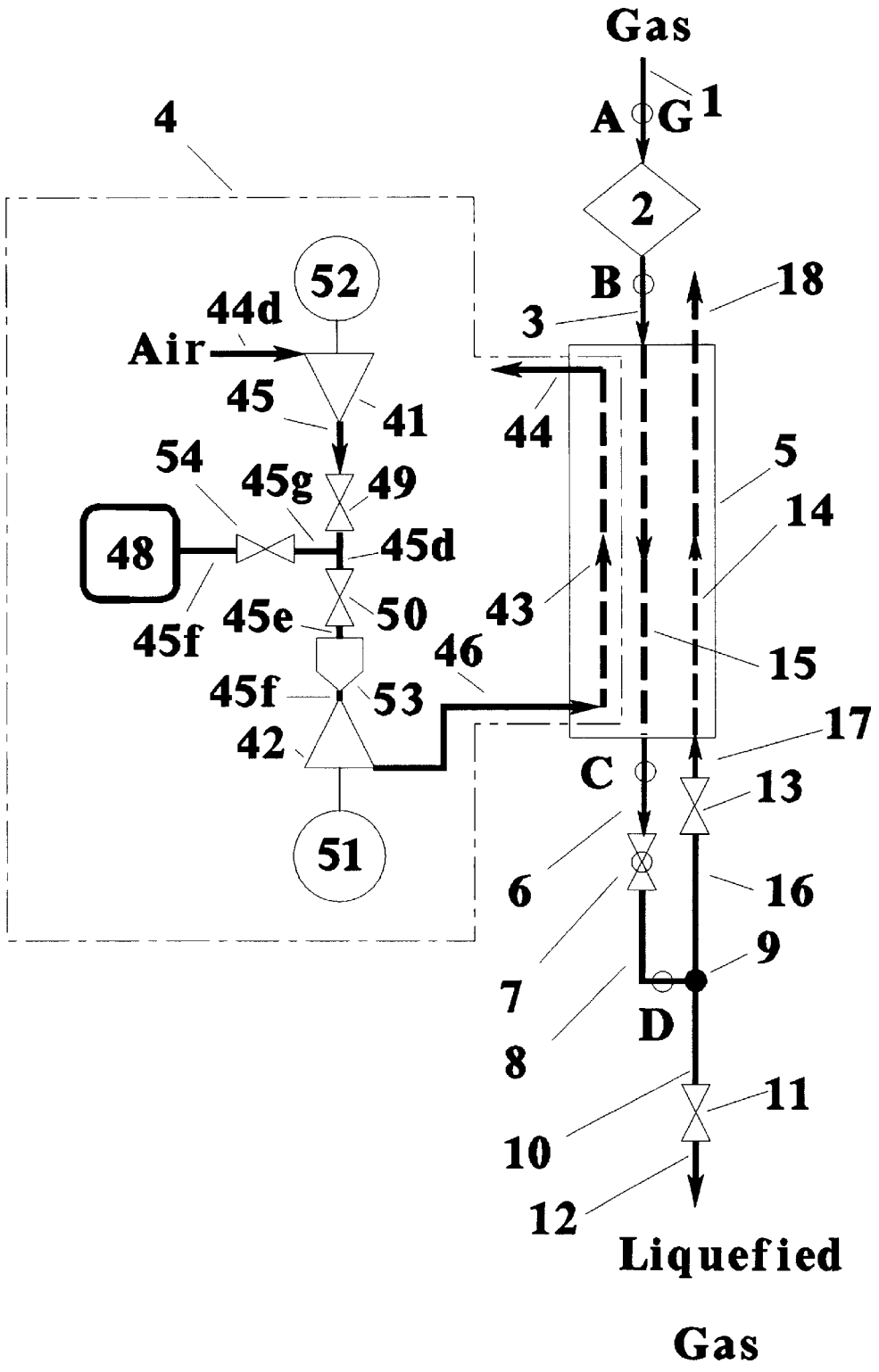
FIG. 8 is a schematic diagram illustrating another useful modification of the apparatus of FIG. 2 where the refrigerator means generates variable temperature air flow and includes a Compressed Air Energy Storage (CAES).

Referring to FIG. 8, a preferred embodiment of the Once-Through-Apparatus for Gas Liquefaction, where the refrigerator means generates variable temperature air flow and includes a Compressed Air Energy Storage (CAES), is shown. In this case, the refrigerator means comprise the compressing and cooling device 41 driven by an electric motor 52, the expander means 42 driving an electric generator 51, and the heat absorbing means 43 connected with the expander means 42 by the line 46 and with the atmosphere by the line 44. Suction line 44*d* of the device 41 is connected with the atmosphere. Connected in series the line 45, a valve 49, a line 45*d*, a valve 50, a line 45*e*, an air purifying device 53 and a line 45*f* are inserted between the device 41 and the expander means 42. A CAES reservoir 48 is connected through a line 45*f*, a valve 54 and a line 45*g* to the line 45*d*.

The air purifying device 53 serves for extracting from air mechanical particles, water droplets, and for air drying to ensure stable operation of the expander means 42 at low temperature of the expanding air.

The CAES reservoir 48 may be of any type known in the art such as salt and rock caverns, storage tanks, aquifers etc.

The refrigerator means shown on FIG. 8 has five operational modes:

Mode No.1. Refrigeration is provided. The CAES reservoir is disconnected from the system.

Mode No.2. Refrigeration is provided. Simultaneous charge of the CAES reservoir takes place.

Mode No.3. Refrigeration is provided. The expander means are fed simultaneously by compressed air delivered from the compressing and cooling device and from the CAES reservoir.

Mode No.4. Refrigeration is provided. The expander means are fed by compressed air delivered only from the CAES reservoir.

Mode No.5. Refrigeration is not provided, and Once-Through-Apparatus for Gas Liquefaction does not produce liquefied gas. There is charging of the CAES reservoir only.

In Mode No.1, the valves 49 and 50 are opened, the valve 54 is closed, the electric generator 51 and the electric motor 52 are connected to electric grid. The compressing and cooling device 41 takes atmospheric air from the line 44*d*, compresses and cools it, then the compressed air is purified in the device 53, and expands in the expander device 42 with work performance, while electric energy is produced by the electric generator 51. Cold air from the expander means 42 is delivered through the line 46 into the heat absorbing means 43 where it cools supercritical pressure gas. From the heat absorbing means 43, the air is evacuated to the atmosphere through the line 44. In this mode, according to the Second Law of thermodynamics, electric power consumed by the electric motor 52 is always greater than electric power produced by the electric generator 51.

In Mode No.2, the valves 49, 50 and 54 are opened, the electric generator 51 and the electric motor are connected to electric grid, and part of the compressed air supplied by the device 41 is purified in the device 53, expands in the expander means 42 with work performance and then cools the supercritical pressure gas, while another part of the compressed air is delivered through the line 45*g*, the valve 54 and the line 45*f* into the CABS reservoir 48 charging it. For Mode No.2, electric power consumption of the electric motor 52 is always greater than electric power production of the electric generator 51.

In Mode No.3, similarly to Mode No.2, the valves 49, 50 and 54 are opened, the electric generator 51 and the electric motor 52 are connected to electric grid, compressed air is purified in the device 53, expands in the expander means 42 with work performance and then cools the supercritical pressure gas. But in this mode of operation, discharge of the CABS reservoir 48 occurs, and the expander means are fed by compressed air delivered not only from the device 41 but also from the CABS reservoir 48. Because of this, the electric power output of the electric generator 51 may exceed electric power consumption of the electric motor 52, and this difference in electric power production and consumption can compensate and even exceed electric power consumption of other elements of the Once-Through-Apparatus for Gas Liquefaction. For this last case, the apparatus becomes an energy generating unit supplying electric energy to electric grid.

In Mode No.4, the valves 50 and 54 are opened, the valve 49 is closed, the electric generator 51 is connected to electric grid, the electric motor 52 is disconnected from the electric grid, the compressing and cooling device 41 is not active, and discharge of the CABS reservoir occurs. Compressed air from the CAES reservoir is purified in the device 53, expands in the expander means 42 with work performance and then cools the supercritical pressure gas. In this mode of operation, the refrigerator means 4 produces electric energy. When this electric power production exceeds the electric power consumption of other elements of the Once-Through-Apparatus for Gas Liquefaction, the apparatus becomes an energy generating unit supplying electric energy to electric grid.

In Mode No.5, the Once-Through-Apparatus for Gas Liquefaction does not produce liquefied gas. The valves 49 and 54 are opened, the valve 50 is closed, the electric generator 51 is disconnected from the electric grid, and the electric motor 52 is connected to the electric grid. The compressing and cooling device 41 takes atmospheric air from the line 44*d*, compresses, cools and delivers it into the CABS reservoir charging it.

The Modes No.2 and No.5 are applied during off-peak hours when the electric system is partially loaded, and the electric energy price is low. During peak load periods, when the electric system is heavily loaded, and the electric energy price is high, the refrigerator means are operated in the Modes No.3 and No.4 ensuring the minimal electric power consumption of the apparatus or even supplying electric power to the grid. Thus, for the Once-Through-Apparatus with the CAES reservoir the operational costs may be minimized. The Mode No.1 is an emergency regime applied, for example, when the CAES reservoir needs maintenance or it did not accumulate enough air.

As will no doubt be clear to those skilled in the art, the embodiments specifically described herein in the above text and in the annexed drawings, are exemplary, and should not be construed as limiting.

We claim:

1. Once-Through-Apparatus for Gas Liquefaction comprising:

a device for thermodynamic conditioning of the gas to be liquefied to achieve the gas supercritical pressure and minimal temperature consistent with ambient conditions;

an inlet line to supply the gas to the device for thermodynamic conditioning of the gas;

external refrigerator means generating distributed variable temperature heat sinks in heat absorbing means, to cool the supercritical pressure gas to a final temperature that is lower than the saturation temperature of the liquefied gas;

a throttling device to expand the cooled supercritical pressure gas without work performance to the prescribed subcritical pressure of the liquefied gas;

a low temperature heat transfer unit comprising said heat absorbing means of said refrigerator means and main heat transfer means, connected by a line to said device for thermodynamic conditioning of the gas and by another line to said throttling device; said heat absorbing means being in thermal contact with said main heat transfer means thereby ensuring transfer of heat from the gas to said heat absorbing means;

an outlet line to supply the liquefied gas to the consumer; means for transferring the liquefied gas from said throttling device to said outlet line.

2. Once-Through-Apparatus for Gas Liquefaction according to claim 1 wherein:

auxiliary heat transfer means are introduced in said low temperature heat transfer unit; said auxiliary heat transfer means being in thermal contact at least with said main heat transfer means;

the means for transferring the liquefied gas comprises a line connected to said throttling device, an interconnection element connected in series with the line and a line with a valve connecting the interconnection element with the outlet line;

the auxiliary heat transfer means are connected by a line with a valve to the interconnection element.

3. Once-Through-Apparatus for Gas Liquefaction according to claim 1 wherein said refrigerator means comprises connected in series by lines the following elements:

compressing and cooling device combining compressor means for compressing gaseous refrigerant with appropriate heat exchanger means for cooling compressed refrigerant by the ambient heat sinks;

expander means for expanding the compressed gaseous refrigerant with performance of work;

heat absorbing means for extracting heat from the supercritical pressure gas by a flow of expanded gaseous refrigerant.

4. Once-Through-Apparatus for Gas Liquefaction according to claim 1 wherein said refrigerator means comprises compressing and cooling device combining compressor means for compressing gaseous refrigerant with appropriate heat exchanger means for cooling compressed refrigerant by the ambient heat sinks to produce at least two flows of compressed and cooled refrigerant;

at least two expander means for expanding the flows of compressed refrigerant with performance of work;

the heat absorbing means having at least two sections for extracting heat from the supercritical pressure gas by the flows of expanded gaseous refrigerant;

at least one regenerative heat exchanger having a high pressure side and a low pressure side;

lines creating at least two circuits for the flows of refrigerant; the first circuit includes connected in series compressing and cooling device, the first expander means and the first section of the heat absorbing means; the second circuit includes connected in series compressing and cooling device, the high pressure side of the heat exchanger, the second expander means, the second section of the heat absorbing means, and the low pressure side of the heat exchanger, while the flows of refrigerant leaving the first section of the heat absorbing means and the low pressure side of the heat exchanger are united into one flow entering the compressing and cooling device.

5. Once-Through-Apparatus for Gas Liquefaction according to claim 1 wherein said refrigerator means comprises compressing and cooling device combining compressor means for compressing gaseous refrigerant with appropriate heat exchanger means for cooling compressed refrigerant by the ambient heat sinks to produce at least two flows of compressed and cooled refrigerant;

at least two expander means for expanding the flows of compressed refrigerant with performance of work;

the heat absorbing means for extracting heat from the supercritical pressure gas by the flows of expanded gaseous refrigerant;

an outlet line connecting the heat absorbing means with inlet of compressing and cooling device;

at least one regenerative heat exchanger having a high pressure side being in heat contact with said heat absorbing means; lines creating at least two circuits for the flows of refrigerant; the first circuit includes connected in series compressing and cooling device, the first expander means and the expander exhaust line connected with an intermediate point of the heat absorbing means; the second circuit includes connected in series compressing and cooling device, the high pressure side of the heat exchanger, the second expander means, and low temperature part of the heat absorbing means.

6. Once-Through-Apparatus for Gas Liquefaction according to claim 1 wherein said refrigerator means comprise:

compressing and cooling device to compress and cool atmospheric air;

an electric motor to drive the compressing and cooling device;

a line connecting the compressing and cooling device with the atmosphere;

an air purifying device to extract from the compressed air mechanical particles, water drops and to dry the compressed air;

lines with valves for connecting said compressing and cooling device with said air purifying device and with a Compressed Air Energy Storage;

expander means to expand compressed air with performance of work and connected by a line with said air purifying device;

electric generator driven by said expander means;

the heat absorbing means supplied through a line by expanded air and connected by a line with the atmosphere.

7. Straightforward Method of Gas Liquefaction comprising the following steps:

thermodynamic conditioning of a gas to be liquefied that comprises compressing said gas to a supercritical pressure and cooling the gas by ambient heat sinks;

refrigerating said supercritical pressure gas by external refrigerator means to a final temperature which is lower than the saturation temperature of the liquefied gas;

throttling said refrigerated supercritical pressure gas to the prescribed subcritical pressure of the liquefied gas.

8. Straightforward Method of Gas Liquefaction according to claim 7, wherein final temperature of the refrigerated supercritical pressure gas is varied, thus controlling rate of subcooling of said liquefied gas.

9. Straightforward Method of Gas Liquefaction according to claim 7, wherein said external refrigerator means generate distributed variable temperature heat sinks disposed for refrigerating said supercritical pressure gas.

10. Straightforward Method of Gas Liquefaction according to claim 7, wherein said external refrigerator means produce at least one flow of cold gas disposed for refrigerating said supercritical pressure gas.

11. Straightforward Method of Gas Liquefaction according to claim 7, wherein said external refrigerator means generate at least one flow of multicomponent refrigerant boiling at variable temperature and disposed for refrigerating said supercritical pressure gas.

* * * * *